US005078157A

United States Patent [19]

Golan et al.

[11] Patent Number: 5,078,157

[45] Date of Patent: Jan. 7, 1992

[54] OSCILLATORY HAIR TREATMENT APPARATUS AND METHOD

[75] Inventors: Zeev Golan; Ruth Golan, both of Herzliya; Shlomo Gilboa; Liora Gilboa, both of Kibbutz Glil Yam, all of Israel

[73] Assignee: Mepro Epilady Ltd., Galilee, Israel

[21] Appl. No.: 443,693

[22] Filed: Nov. 30, 1989

[30] Foreign Application Priority Data

| | | | |
|---|---|---|---|
| Dec. 1, 1988 | [IL] | Israel | 88550 |
| Feb. 12, 1989 | [IL] | Israel | 89267 |
| Feb. 24, 1989 | [IL] | Israel | 89416 |
| Mar. 9, 1989 | [IL] | Israel | 89561 |
| Nov. 23, 1989 | [IL] | Israel | 92414 |

[51] Int. Cl.[5] ..... A45D 24/00

[52] U.S. Cl. ..... 132/119.1; 132/143

[58] Field of Search ..... 132/112, 113, 114, 119.1, 132/124, 143, 144, 150, 152, 155, 120, 108, 129, 136, 142, 271; 15/22.1, 22.2

[56] References Cited

U.S. PATENT DOCUMENTS

| | | | |
|---|---|---|---|
| 2,206,365 | 7/1940 | Pieper | 132/152 |
| 2,479,253 | 9/1947 | Prediger | 132/119.1 |
| 3,204,469 | 5/1963 | Spillers | 132/119.1 |
| 3,252,175 | 10/1964 | Pedersen | 15/22 B |
| 3,272,023 | 11/1964 | Ferguson | 132/119.1 |
| 3,349,782 | 8/1965 | Sawin | 132/119.1 |
| 3,358,309 | 12/1965 | Richardson | 15/22 R |
| 3,384,096 | 3/1965 | Paccione | 132/119.1 |
| 3,421,522 | 2/1965 | Magguilli | 132/119.1 |
| 3,427,674 | 6/1966 | Tone et al. | 15/23 |
| 3,461,883 | 8/1966 | Maris | 132/119.1 |
| 3,474,795 | 2/1966 | Hantman | 132/119.1 |
| 3,701,354 | 10/1972 | May | 132/119.1 |
| 3,750,680 | 6/1972 | Miller | 132/119.1 |
| 3,782,395 | 1/1974 | Sarna | 132/212 |
| 3,794,050 | 5/1974 | Gallanis et al. | 132/119.1 |
| 3,840,030 | 5/1974 | Baker | 132/119.1 |
| 3,850,180 | 11/1974 | Rydemen, Jr. et al. | 132/119.1 |
| 3,850,181 | 11/1974 | Baker | 132/119.1 |
| 3,853,133 | 12/1974 | Komatsu et al. | 132/119.1 |
| 3,863,652 | 8/1975 | Scivoletto | 132/119.1 |
| 3,870,056 | 11/1975 | Stemme | 132/119.1 |
| 3,894,547 | 12/1975 | Scivoletto | 132/119.1 |
| 3,894,549 | 12/1975 | Scivoletto | 132/119.1 |
| 3,897,794 | 12/1975 | Branch | 132/119.1 |
| 3,942,538 | 4/1976 | Deppeler | 132/119.1 |
| 3,964,502 | 6/1976 | Komatsu | 132/119.1 |
| 4,139,014 | 4/1977 | Rowland | 132/119.1 |
| 4,376,441 | 3/1983 | Duncan | 132/112 |
| 4,532,707 | 8/1985 | Allen | 30/200 |
| 4,612,944 | 9/1986 | Bachrach et al. | 132/159 |
| 4,612,945 | 9/1986 | Bachrach | 132/142 |
| 4,632,135 | 12/1986 | Lenting | 132/313 |
| 4,729,147 | 3/1988 | Armbruster | 15/314 |

OTHER PUBLICATIONS

K. A. Saunders, "Treatment of Head Lice", Pharmaceutical Journal, Sep. 1984.

J. W. Maunder, "Parasites and Man, Human Lice—Biology and Control", Journal of the Royal Society of Health, 1977.

*Primary Examiner*—John J. Wilson

*Assistant Examiner*—Frank A. LaViola

*Attorney, Agent, or Firm*—Cushman, Darby & Cushman

[57] ABSTRACT

Apparatus for treating hair including a handle, hair separation apparatus associated with the handle and extending longitudinally along an axis, apparatus for oscillating the hair separation apparatus about the axis so as to bring the hair separation apparatus into repeated engagement with a group of hairs so as to ease passage of the separation apparatus therethrough, and apparatus for preventing the hair separation apparatus from striking a portion of skin to which the hairs are attached. The hair separation apparatus is oscillated about the axis at a relatively high frequency, of, typically, greater than 4,000 cycles per minute and preferably greater than 10,000 cycles per minute, and at a relatively small amplitude, of, typically, no larger than about 5° and, preferably, no larger than 2°. A method of delousing hair includes the steps of placing hair separation apparatus in a group of hairs and oscillating the hair separation apparatus at high frequency, so as to bring the hair separation apparatus into repeated engagement with the group of hairs in a direction generally transverse to the length of the hairs, thereby also bringing the hair separation apparatus into repeated engagement with lice and lice eggs located among the hairs, so as to cause fatal injury to the lice and lice eggs.

32 Claims, 13 Drawing Sheets

FIG.11
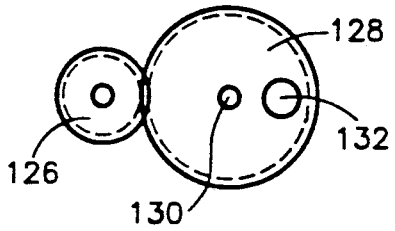
FIG.12
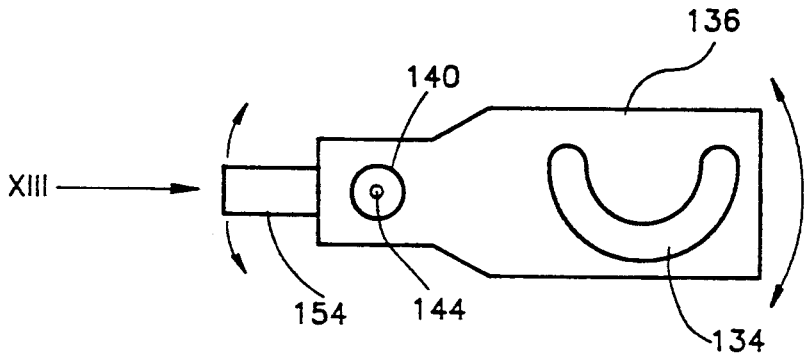
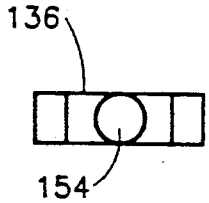
FIG.13
FIG.14
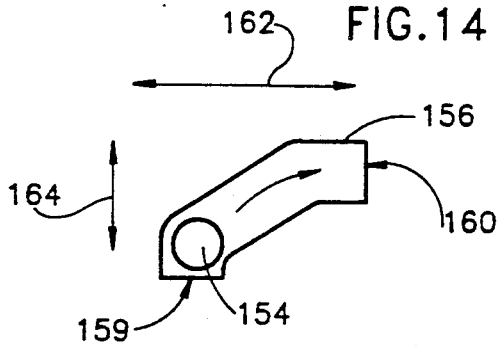
FIG.15
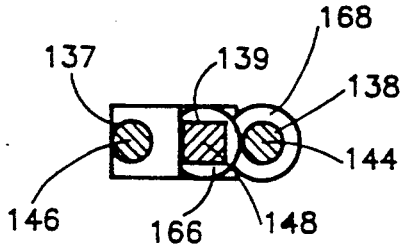
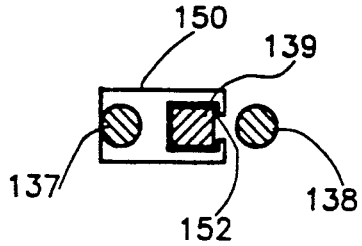
FIG.16

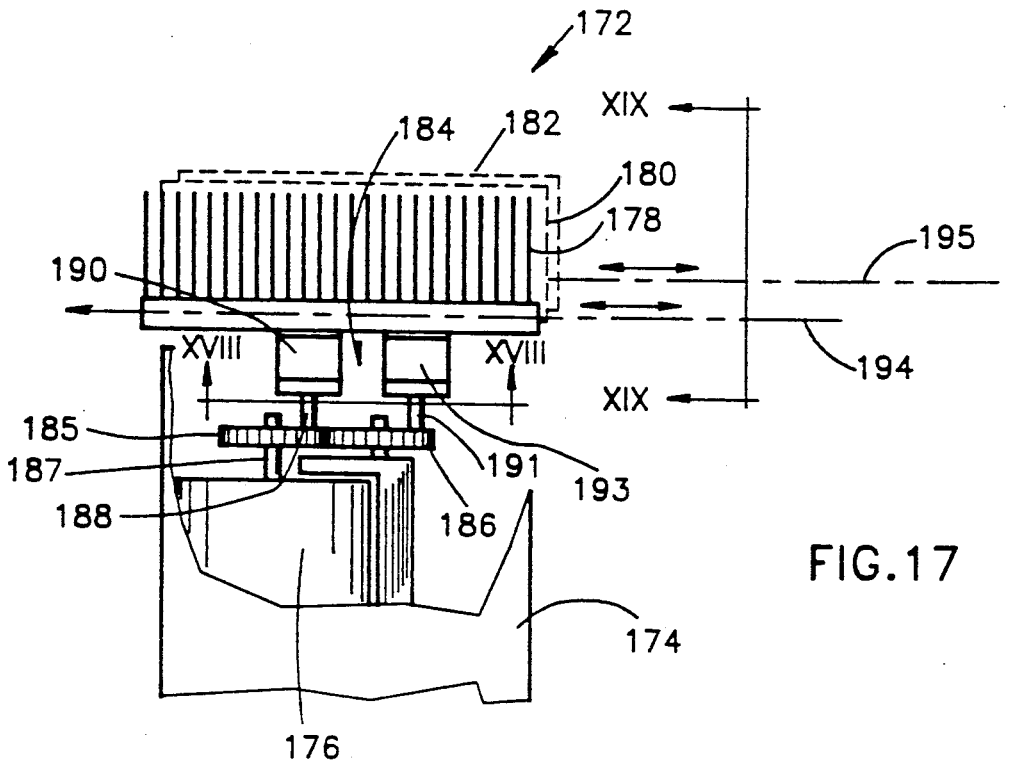
FIG.17
FIG.18
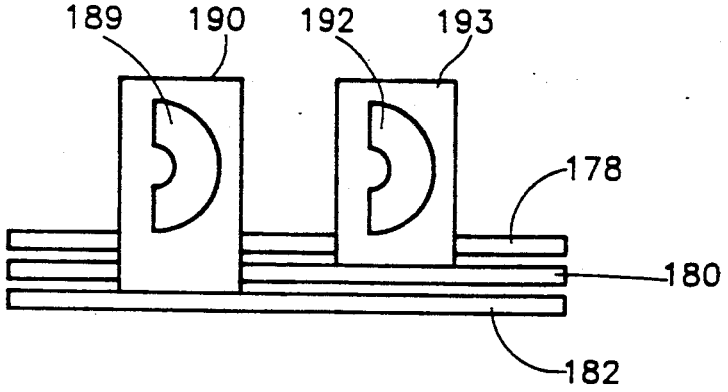
FIG.19
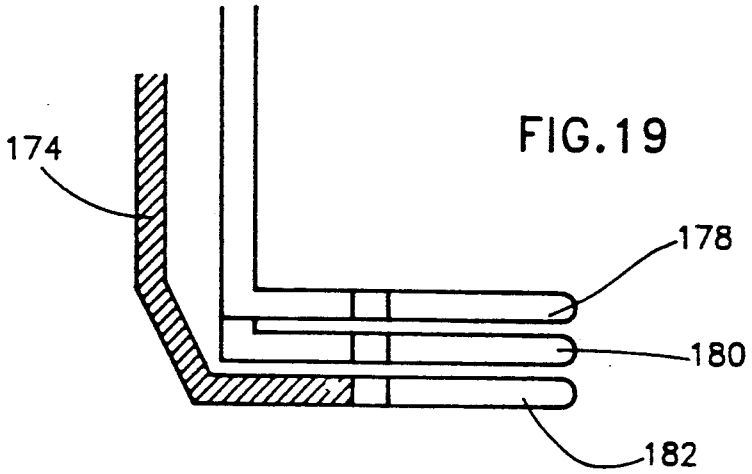

FIG.24
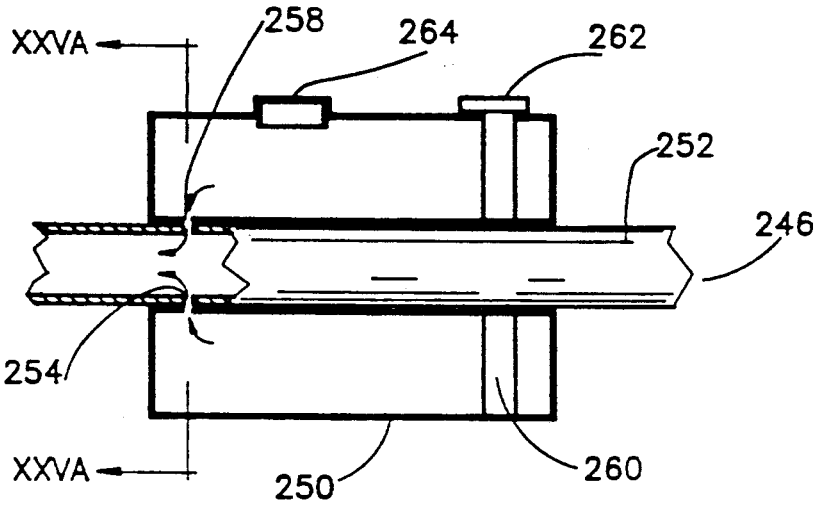
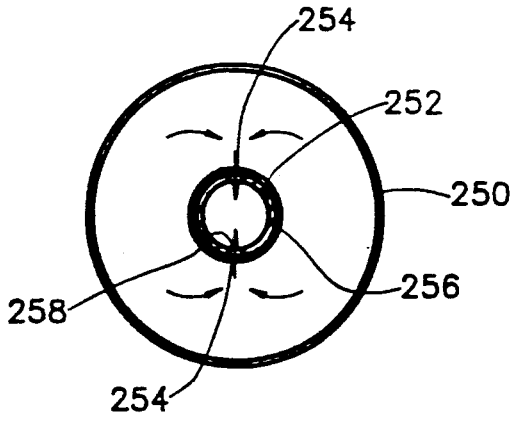
FIG.25A
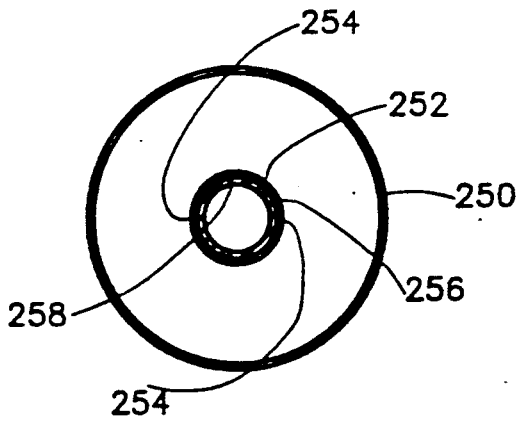
FIG.25B

OSCILLATORY HAIR TREATMENT APPARATUS AND METHOD

FIELD OF THE INVENTION

The present invention relates to apparatus and methods for treatment of the hair and an associated portion of skin of humans and animals.

BACKGROUND OF THE INVENTION

Many different types of device are available for combing the hair, whether for grooming purposes or for purposes of treating hair and/or scalp conditions, such as removal of lice and dandruff.

Disclosed in U.S. Pat. No. 4,532,707 to Allen is an animal hair shear and cutting device. The device comprises electrically operated animal hair shear or cutting apparatus including an electric motor and housing therefor, a hair cutting blade for reciprocal motion by the electric motor, a conventional toothed comb carried by the apparatus and a second comb carried by the apparatus together with the first comb, the first comb being disposed in spaced relation between the blade and the second comb.

A pet groomer and flea annihilator is disclosed in U.S. Pat. No. 4,729,147 to Armbruster. This device is portable and includes a comb for grooming, removing loose hair, dirt, dandruff and the like and a vacuum device associated with the comb.

Disclosed in U.S. Pat. No. 4,632,135 to Lenting is a hair grooming device comprising a hollow elongate holder having a comb or brush attachment fitted onto one end portion thereof. A high voltage source is enclosed in the holder for ion generation. An elongate conductive support is mounted in and insulated from the holder and electrically connected to the high voltage source, such support extending parallel to and opposite the brush or comb attachment. At least one row of electrodes extends outwardly from the support towards the holder. There is a slot-like opening in the holder in registration with each row of electrodes so as to facilitate escape of the generated ions to the exterior of the holder.

U.S. Pat. No. 3,474,795 to Hantman et al discloses a hair dressing device having an electric motor and drive mechanism releasably connected to a comb for rapidly oscillating the comb. The comb defines a relatively wide, elongate portion and a plurality of teeth extending transversely from the elongate portion.

The comb is arranged so as to be oscillated by the drive mechanism about an axis extending parallel to the elongate portion and also extending through the junction points of the teeth and the elongate portion, or through the teeth at a location somewhat spaced from the junction points.

As the comb is oscillated, no force is imparted to hairs it may be sought to separate along the axis, portions of the comb lying along the axis thus defining 'dead points'. At a distance from the axis a force is, however, delivered by the teeth in proportion to the distance from the axis.

It will thus be appreciated that the device to Hantman et al is inefficient, as at least a portion of each tooth serves no useful purpose in freeing knots and tangles in the hair it engages.

Furthermore, the amplitude of oscillation of the teeth and thus the force delivered thereby is directly proportional to their perpendicular distance from the axis.

Thus, in order to obtain even a relatively small amplitude of oscillation at a point on each tooth element relatively close to the axis, the amplitude of oscillation of the points furthest from the axis and thus the force delivered thereat is unacceptably large. The amplitude of oscillation typically employed is relatively large, a preferred range being from 20° to 40°, while "... useful results may generally be obtained in the range 5° to 150° ...".

The relatively large amplitude employed by Hantman et al is combined with a relatively low frequency of oscillation which may vary between 100 and 4,000 cycles per minute.

As the scalp is a relatively sensitive portion of the skin, particularly when being struck at a relatively low frequency, use of the device to Hantman et al would be, therefore, very uncomfortable, due to the repeated low frequency striking of the scalp with a relatively large force that would invariably occur.

Disclosed in U.S. Pat. No. 3,850,181 to Baker is a hair detangling device which has a pair of fixed combs spaced about an axis, and a movable comb which is aligned along the axis and is reciprocated therealong so as to detangle hair with which the combs are engaged. The teeth of the combs extend perpendicular to the axis and, in order to permit access of the movable member to the scalp, the teeth of the movable member are longer, and thus protrude beyond the teeth of the fixed combs. As the reciprocating movement of the movable comb is along the axis and not transverse to it, the problem outlined above, of repeated striking of the scalp, is not present with the hair detangler.

Disclosed in U.S. Pat. No. 3,384,096, to Paccione is an oscillatory teasing comb comprising a housing having an annular portion at one end and a flat and open longitudinal portion extending for substantially the length of a comb and terminating in a raised portion. Means are provided for pivotally mounting the frame in the housing, on the inner face thereof, in order to permit an oscillating movement of the frame in the housing. A drive shaft is rotatably mounted relative to the housing having eccentric means on the drive shaft, and means for automatically selectively oscillating the drive shaft are provided, as well as a plate for operatively connecting the drive shaft with the frame for oscillating movement of the latter, and a teasing comb removably secured in the frame and joining the oscillating movement of the latter.

The teasing comb has a plurality of teeth spaced from an axis and operative to be oscillated thereabout. The spacing of each tooth from the axis is relatively small, however, being approximately one-tenth of the length of a tooth, and does not provide a satisfactory solution to the 'dead point' described above in connection to the device of Hantman et al. Furthermore, Paccione does not disclose a preferred amplitude of oscillation of the comb about the axis nor does he disclose a preferred frequency of oscillation.

Various additional powered hair treatment devices are disclosed in U.S. Pat. Nos. 2,479,253, 3,204,469, 3,252,175, 3,272,023, 3,349,782, 3,358,309, 3,421,522, 3,427,674, 3,750,680, 3,794,050, 3,840,030, 3,853,133, 3,863,652, 3,870,056, 3,894,547, 3,894,549, 3,897,794, 3,942,538, 3,964,502 and 4,139,014.

There are available a number of different types of treatment for the removal of parasites, such as lice, that live in human hair. Among these treatments are chemical treatments such as special types of shampoo and mechanical treatments provided by purpose-made combs. These are often used in combination.

Combing the hair as a means of killing and/or removing lice from the hair is well known. For example, in an article by K. A. Saunders, BPharm, MPS, entitled 'Treatment of Head Lice', published in *The Pharmaceutical Journal*, issue date Sept. 22, 1984, the author states that the head louse cannot recover from injury, loss of a leg being fatal injury to the head louse. The author further recommends that regular thorough grooming of the hair with a comb is, therefore, the best way to prevent infestation with head lice. A similar statement is made in an article by J. W. Maunder, MSc, BSc, entitled 'Parasites and Man. Human Lice—Biology and Control', published in the *Journal of the Royal Society of Health* in 1977.

Disclosed in U.S. Pat. No. 4,612,944 to Bachrach and Teale and in U.S. Pat. No. 4,612,945, to Bachrach, is a comb for removing lice and nits from the hair. The comb comprises a base and a plurality of teeth extending from the base in substantially the same direction. The longitudinal axes of the tooth are parallel to each other. Each tooth has a polygonal cross section shape, this being a diamond shape in the patent to Bachrach and Teale and a triangle shape in the patent to Bachrach. The cross-sectional dimensions of each tooth enlarge from the free end thereof toward the base so that the spacing between adjacent teeth narrows toward the base. The facing edges of adjacent teeth interact with each other to capture, in a scissor-like manner, lice and nits therebetween.

Among disadvantages of the recommended conventional combing and use of the comb to Bachrach and Teale and to Bachrach, is that individual hairs tend to become tightly knotted together or stuck together and thorough combing of the hair may, therefore, be extremely painful and difficult to do efficiently and, over a long period of time, the combing treatment may be ceased.

SUMMARY OF THE INVENTION

It is an aim of the present invention to provide apparatus and a method for fast, efficient and comfortable grooming of the hair of humans and animals.

It is a further aim of the invention to provide apparatus and a method for dislodging and removing from the hair lice, lice eggs, dirt and other unwanted particulate matter.

It is an additional aim of the invention to provide apparatus and a method for elimination of head lice by fatally injuring them.

There is provided, therefore, in accordance with an embodiment of the invention, apparatus for treating hair including a handle; hair separation apparatus associated with the handle and extending longitudinally along an axis; apparatus for oscillating the hair separation apparatus about the axis so as to bring the hair separation apparatus into repeated engagement with a group of hairs so as to ease passage of the separation apparatus therethrough; and apparatus for preventing the hair separation apparatus from striking a portion of skin to which the hairs are attached.

Additionally in accordance with an embodiment of the invention, the hair separation apparatus includes hair combing apparatus including generally elongate base apparatus arranged along the axis; and a plurality of teeth lying transversely to the axis and attached to the base apparatus so as to be separated from the axis.

Further in accordance with an embodiment of the invention, the apparatus for partially preventing includes a generally elongate static member arranged parallel to the axis.

Additionally in accordance with an embodiment of the invention, the apparatus for oscillating is operative to cause oscillation of the plurality of teeth within a predetermined area, and the elongate static member has a comb-like configuration and includes a generally elongate base portion; and a plurality of spaced apart tooth-like transverse protrusions fixed to the base portion, the protrusions extending beyond the area of movement of the plurality of teeth so as to partially or completely prevent contact of the skin by the plurality of teeth.

Further in accordance with an embodiment of the invention, the transverse protrusions are wider than the teeth in a direction taken perpendicular to the axis, and the apparatus for oscillating is operative to oscillate the hair separation apparatus between predetermined limits such that in a direction taken parallel to the axis, the free ends of the teeth always overlap the protrusions.

Additionally in accordance with an embodiment of the invention, the apparatus for treating hair also includes apparatus for dispensing a liquid in association with some or all of the plurality of teeth.

Further in accordance with an embodiment of the invention, the oscillation of the hair separation apparatus is operative to ease passage of the hair separation apparatus through the group of hairs by repeatedly striking the hairs so as to remove therefrom knots and tangles, the apparatus for treating hair also including apparatus for absorbing the striking force applied to the hairs so as to prevent the force from being transmitted to the portion of skin to which the hairs are attached.

According to an additional embodiment of the invention, there is provided hair treatment apparatus having a handle; hair combing apparatus including generally elongate base apparatus arranged along an axis, and a plurality of teeth lying transversely to the axis and attached to the base apparatus so as to be separated from the axis; and apparatus for oscillating the hair combing apparatus about the axis at a relatively high frequency, of, typically, greater than 4,000 cycles per minute and preferably greater than 10,000 cycles per minute, and at a relatively small amplitude, of, typically, no larger than about 5° and, preferably, no larger than 2°, so as to bring the hair separation apparatus into repeated engagement with a group of hairs, thereby to ease passage of the hair combing apparatus therethrough.

According to an alternative embodiment of the invention, there is provided apparatus for treating hair including a handle; hair separation apparatus associated with the handle and extending longitudinally along an axis; apparatus for oscillating the hair separation apparatus in a direction having a component along the axis so as to bring the hair separation apparatus into repeated engagement with a group of hairs so as to ease passage of the separation apparatus therethrough by repeatedly striking the hairs so as to remove therefrom knots and tangles; apparatus for absorbing the striking force applied to the hairs so as to prevent the force from being transmitted to a portion of skin to which the hairs are attached; and apparatus for preventing the hair separation apparatus from striking the portion of skin to which the hairs are attached.

According to yet a further embodiment of the invention, there is provided a method of delousing hair including the steps of placing hair separation apparatus in a group of hairs; oscillating the hair separation apparatus at high frequency, so as to bring the hair separation apparatus into repeated engagement with the group of hairs in a direction generally transverse to the length of the hairs, thereby also bringing the hair separation apparatus into repeated engagement with lice and lice eggs located among the hairs, so as to cause fatal injury to the lice and lice eggs.

BRIEF DESCRIPTION OF THE DRAWINGS

The present invention will be understood and appreciated more fully from the following detailed description, taken in conjunction with the drawings, in which:

FIG. 11 shows a pair of drive wheels shown in FIG. 10, as viewed from line XI—XI therein;

FIG. 12 shows a transmission element shown in FIG. 10, as viewed from line XII—XII therein;

FIG. 13 shows the transmission element of FIG. 12, as viewed from line XIII—XIII therein;

FIG. 14 shows a shaped groove defined by a wall portion of the apparatus of FIG. 10, as viewed from line XIV—XIV therein;

FIG. 15 is a view taken along line XV—XV in FIG. 10;

FIG. 16 is a view taken along line XVI—XVI in FIG. 10;

FIG. 17 is a schematic, partial cut-away view of hair treatment apparatus constructed according to a further alternative embodiment of the invention;

FIG. 18 shows the apparatus of FIG. 17, as viewed from line XVIII—XVIII therein;

FIG. 19 is a partial side view of the apparatus of FIG. 17, as viewed from line XIX—XIX therein;

FIG. 24 is a detailed, side-sectional view of the liquid container shown in FIG. 22;

FIG. 25A is a cross-sectional view of the container shown in FIG. 24, taken along line XXVA—XXVA therein, wherein passage of the liquid from the container into the conduit system is permitted; and FIG. 25B is a view similar to that of FIG. 25A, but wherein passage of the liquid from the container into the conduit system is prevented.

DETAILED DESCRIPTION OF THE INVENTION

Figure 1:
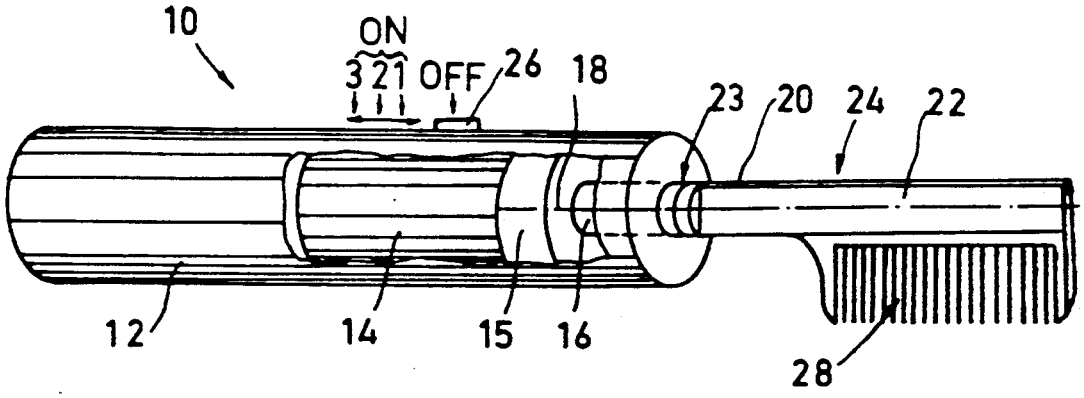
FIG. 1 is a schematic representation of hair treatment apparatus employing a lice comb, constructed and operative in accordance with an embodiment of the invention.
Figure 2:
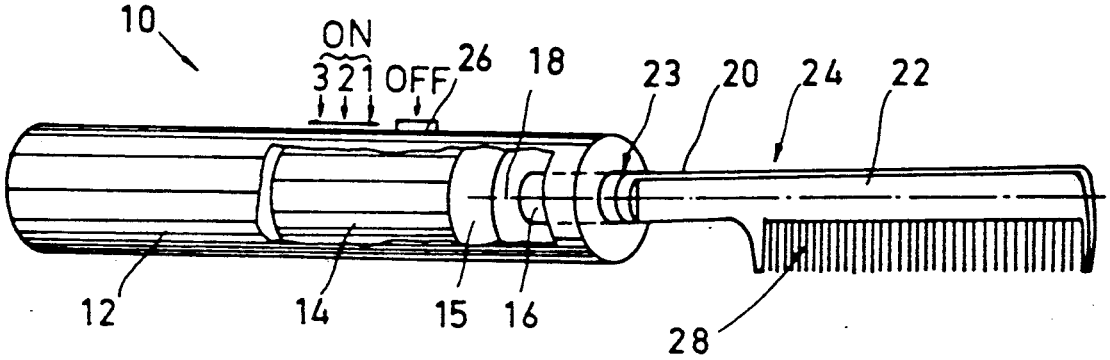
FIG. 2 is a schematic representation of hair treatment apparatus employing a conventional pocket comb, constructed and operative in accordance with an alternative embodiment of the invention.
Figure 3:
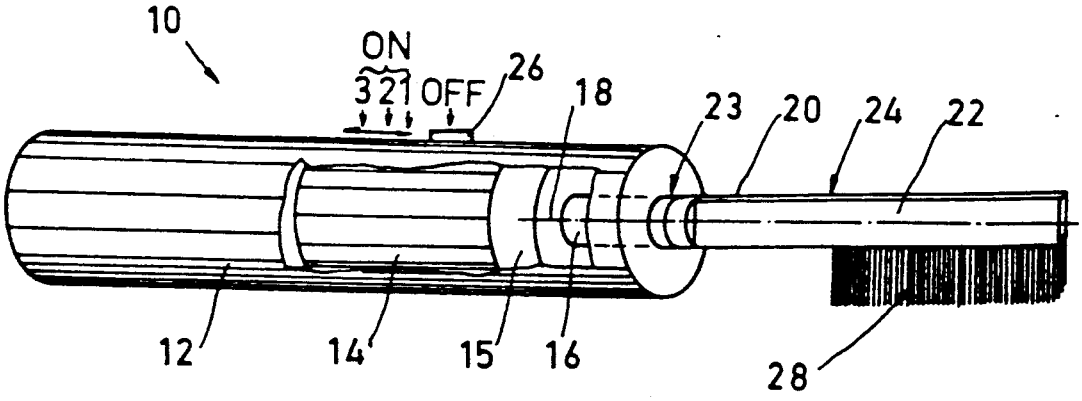
FIG. 3 is a schematic representation of hair treatment apparatus employing a brush element, constructed and operative in accordance with a further embodiment of the invention.

With reference to FIGS. 1-3, there is provided a portable, typically hand-held, hair treatment device, referenced generally 10. Device 10 comprises a hollow, elongate handle 12 which also serves as a housing for a motor 14, such as a 2.4 V dc motor, catalog reference RE-280-2865, made by MABUCHI of 430, Matasuhidai, Matsudo-Shi, Chiba-Ken, 270, Japan. There is also provided a transmission assembly 15 for providing a predetermined motion, as will be described in greater detail below, with reference to FIGS. 4A-8. Handle 12 is typically made from plastic.

The motor 14 may be powered by any suitable power source (not shown), such as batteries, rechargeable batteries or, together with suitable transformer apparatus, an A.C. mains current source. An elongate member 16 associated with transmission 15 lies along an axis 18 and is connected to an elongate arm 20 made typically from a rigid plastic and to which is connected a hair separation element 22, arranged for predetermined reciprocal movement in relation to axis 18, as described in greater detail below in conjunction with FIGS. 4A–8. The connections between element 22 and arm 20, shown at 23, and arm 20 and member 16, shown at 24, may be bayonet connections or any other suitable, preferably detachable connection.

Hair separation element 22 is intended to be passed through the hair in a direction generally transverse to the length of the hair. In the ensuing description, therefore, unless otherwise stated, passage of element 22 through the hair or engagement of hairs thereby is taken to be generally transverse to the length of the hair.

There is also provided a selector 26, typically a slidable switch, mounted onto handle 12 and having typically a single OFF position and one or more ON positions. In the shown example, three different ON positions are shown, each of which represents a different motor speed. The selection of different motor speeds may be provided by any suitable means, such as a rheostat (not shown).

Hair separation element 22 comprises a plurality of preferably parallel elongate elements 28, lying transversely, preferably perpendicular, to axis 18. Element 22 is, as described, removable from arm 20 and, according to different embodiments of the invention, representing different applications of device 10, element 22 may be a metal or plastic lice comb (FIG. 1), such as disclosed in either of the U.S. Patents to Bachrach and Teale or to Bachrach, a conventional metal or plastic pocket comb (FIG. 2), a brush head (FIG. 3) or any other type of apparatus useful in accordance with an embodiment of the invention.

It is of importance that the points where elements 28 are joined to the remainder, or base, of element 22, are spaced from axis 18. Thus, there is no 'dead point', whereat no force is delivered by elements 28, such as would be the case of the axis were to extend through the elements 28. According to a preferred embodiment, the junction points of the elements 28 with the remainder of element 22 are spaced from the axis by a distance equal to at least about one-quarter of the length of elements 28.

In addition to the effective use of the entire length of each element 28, although the force delivered at the free end of each element 28 is greater than that delivered at the beginning of each element 28, the additional force delivered at the free end of each element 28 does not have to be excessive in order to generate at least a minimum required force at the opposite end. It will be appreciated that the further the beginning of the elements 28 is from axis 18, the less significant becomes the additional distance along each element 28 between the two ends thereof.

It will be appreciated that the above-mentioned choice of motor speeds cause correspondingly different frequencies of oscillation of element 22. The selected speed will depend upon, inter alia, the type of hair, the type and size of element 22 and size and spacing of elongate elements 28. The frequency of oscillation of element 22 about axis 18 is relatively high typically greater than 3,000 cycles per minute (CPM), preferably greater than 4,000 CPM and, more preferably, between 10,000 and 15,000 CPM. In combination with the high frequency of oscillation, element 22 is operated a low amplitude of oscillation, typically being confined to an amplitude of no greater than about 5°, and preferably of about 1°–2°. It will be appreciated that oscillation of element 22 at a high frequency and a low amplitude provides a motion that is both efficient and relatively painless.

With particular reference to FIG. 1, element 22 is, according to an embodiment of the invention, a lice comb. It has been found that the reciprocal motion of the comb when being passed through hair so as to repeatedly strike individual hairs with which it is brought into engagement, causes separation of the individual hairs, whether knotted together, stuck together or otherwise joined. It has been further found that the separation facilitates quick, efficient and comfortable passage of the comb through the hair, generally without uprooting hairs, such as occurs with conventional use of hair combs.

When element 22 which, according to the present embodiment is passed through the hair close to the scalp, lice and lice eggs attached to individual hairs or to the scalp are physically engaged by elongate elements 28 so as to be loosened and subsequently removed from the hair. Any live lice that are left behind are almost certainly injured by the physical engagement of elements 28 and, as described in the 'Background of the Invention', subsequently die within a relatively short space of time.

It will be appreciated that use of the present invention for lice removal is particularly advantageous when used on young children, as they generally have less patience to sit for a long time while their hair is combed manually. They also generally have a lower resistance to the pain that is generally caused while freeing the knots in their hair.

Referring now additionally to FIG. 2, a further application of the invention, whether employing a lice comb (FIG. 1) or an ordinary comb (FIG. 2), is that of removing dandruff particles from the scalp and subsequent removal of the particles from the hair.

With reference also to FIG. 3, and according to yet a further embodiment of the invention, when element 22 is a conventional comb (FIG. 2) or a brush element (FIG. 3), device 10 is useful as a tool for hair styling. It has been found that use of device 10 causes separation of hairs from each other so as to facilitate entry of air between hairs. Device 10 may, therefore, be used for styling hair by moving it in a chosen direction and at a chosen angle with respect to the hairs, thus causing the individual hairs to become straightened, for example, or otherwise arranged.

Figure 4A:
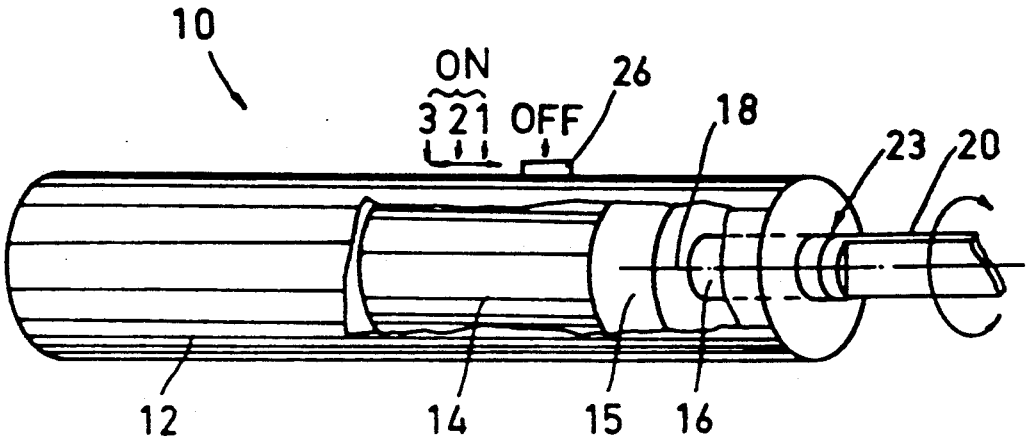
FIG. 4A is a schematic representation of hair treatment apparatus as shown in FIG. 1, operative to produce rotational reciprocal motion of the hair separation element about an axis defined thereby.

Reference is now made to FIG. 4A in which there is shown hair treatment device 10, wherein transmission 15 causes a reciprocal rotation of arm 20, typically of no more than about ten degrees, about axis 18, producing a similar reciprocal rotation of element 22 (FIGS. 1–3).

According to one embodiment of the invention, element 22 is a lice comb as shown and described in conjunction with FIG. 1.

Figure 8:
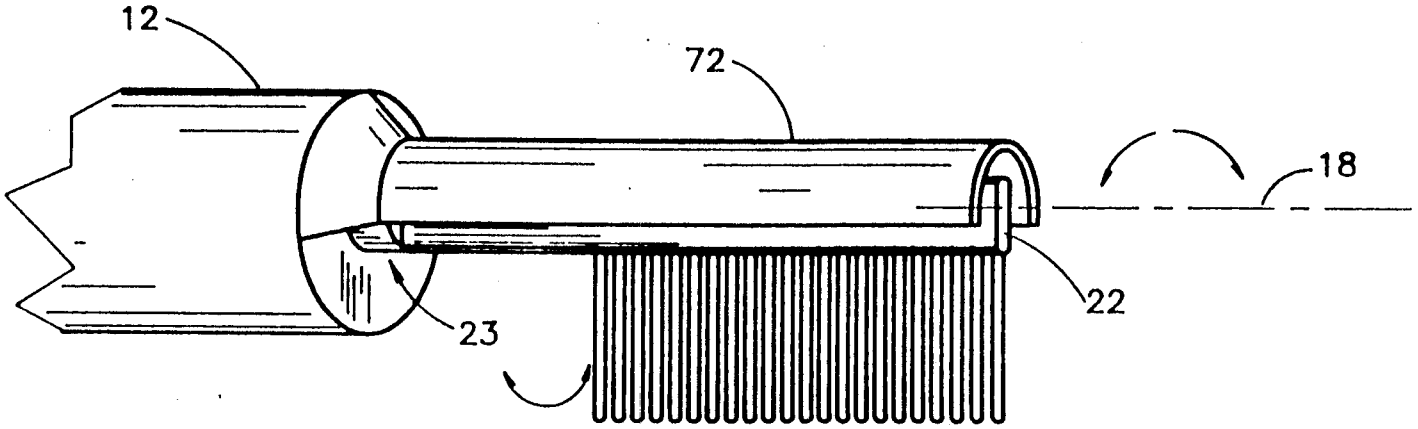
FIG. 8 is a schematic representation of the apparatus shown in FIG. 4A and including a scalp guard constructed according to an embodiment of the invention.

According to an alternative embodiment of the invention, and with reference to FIG. 8, element 22 may be any of the different elements shown in FIGS. 1–3. In order to prevent the repeated striking of the scalp by element 22, there is provided a scalp guard element 72 mounted onto housing 12.

In use, element 72 prevents, for the most part, direct contact between element 22 and the scalp. As will be appreciated by persons skilled in the art, device 10, including the scalp guard 72, is a useful hair styling accessory.

Figure 9C:
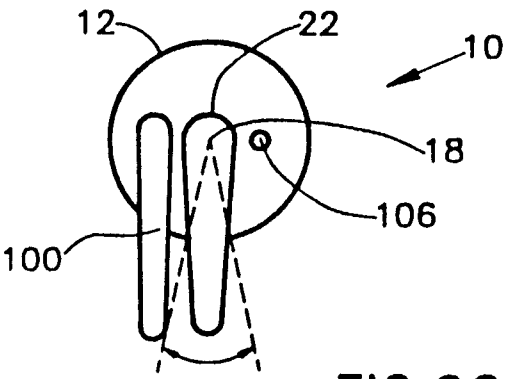
FIGS. 9A, 9B and 9C are respective schematic side, top and end views of the apparatus shown in FIG. 4A and including a scalp guard constructed according to an alternative embodiment of the invention.
Figure 9A:
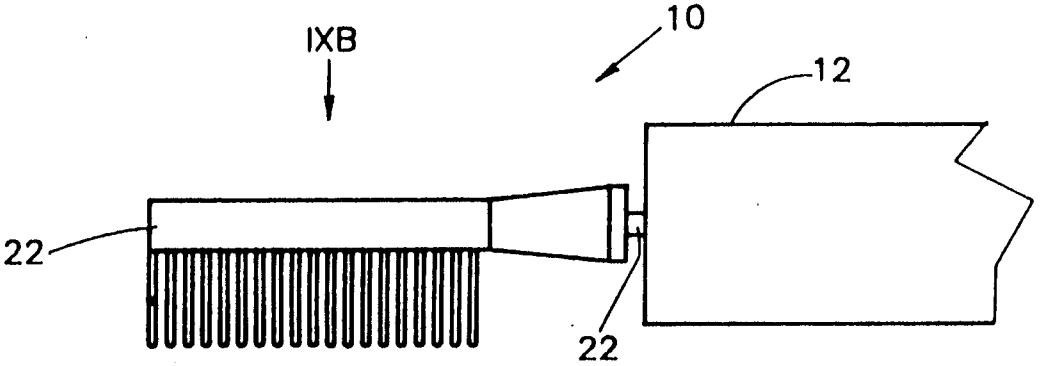
Figure 9B:
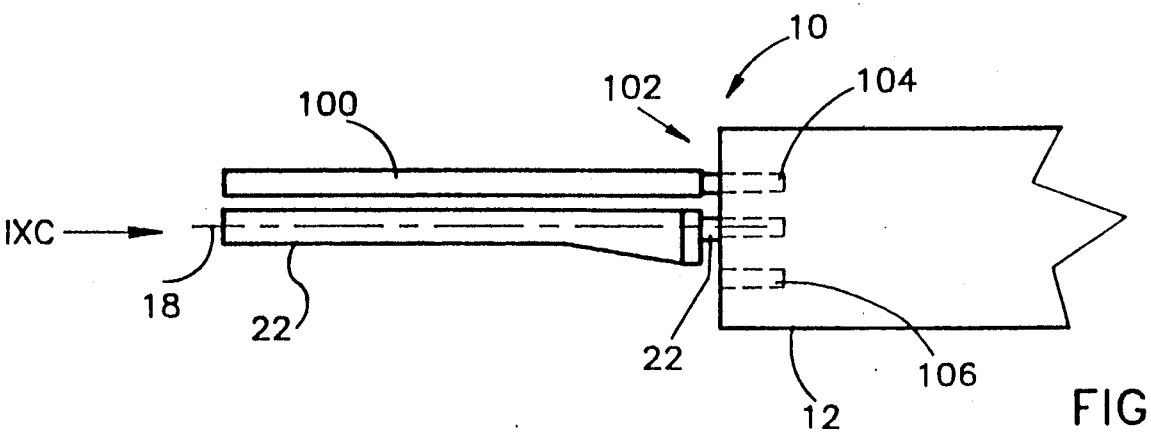

Reference is now made to FIGS. 9A, 9B and 9C, in which there is shown the apparatus 10 as illustrated in FIG. 4A and including a scalp guard element 100 (FIGS. 9A and 9B) constructed according to a further alternative embodiment of the invention.

According to the present embodiment, element 22 may be any of the different elements shown in FIGS. 1-3. The provision of scalp guard element 100 prevents the discomfort that would otherwise be caused, resulting from the repeated striking of the scalp with an unacceptably large force, as described in the background of the invention with regard to the device of Hantman et al.

Element 100 is typically a conventional hair comb and has an end 102 configured for removal insertion into socket 104 defined by handle 12. The connection thereat is, for example, a bayonet connection. The comb-like configuration of element 100, it will be appreciated, is configured for passage through the hair, and provides a barrier between element 22 and the scalp.

According to the shown embodiment, there is also provided an additional socket 106 similar to socket 104, so as to permit mounting of element 100 to either side of element 22, as preferred by a user.

Figure 4C:
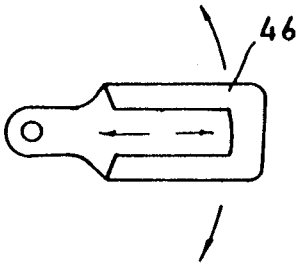
FIG. 4C shows a bottom view of the grooved member of the transmission assembly shown in FIG. 4B.
Figure 4D:
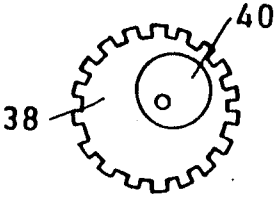
FIG. 4D shows a top view of the second toothed wheel of the transmission assembly shown in FIG. 4B.
Figure 4B:
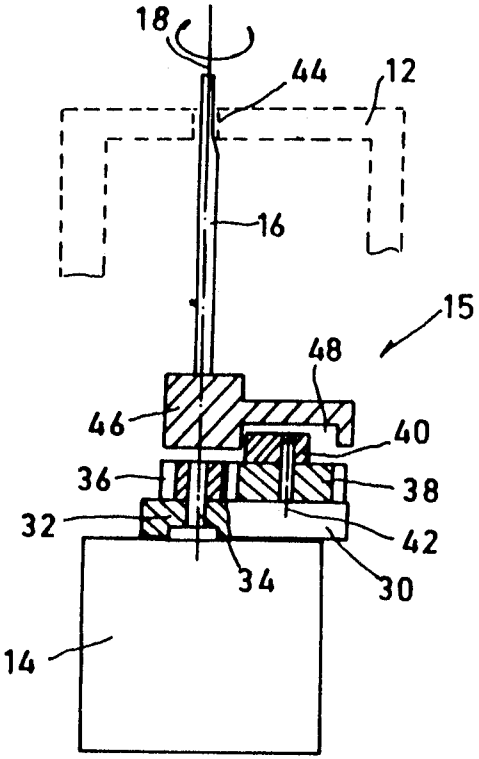
FIG. 4B is a schematic, partially cut away side view of the transmission of the apparatus shown in FIG. 4A.

Referring now additionally to FIGS. 4B-4D, transmission assembly 15 comprises a flat base plate 30, typically made of plastic, mounted onto motor 14 and defining an aperture 32 through which the rotor, referenced 34, of motor 14, extends. Axially mounted onto rotor 34 is a first toothed wheel 36. A second toothed wheel 38, defining an eccentric protrusion 40, is mounted onto base plate 30 for rotation about an axis 42.

Elongate member 16, which is supported in an aperture 44 of housing 12 is mounted along axis 18 and extends from a member 46 defining a groove 48, arranged for cooperation with protrusion 40 of second toothed wheel 38. As motor 14 is activated so as to rotate rotor 34 and thereby rotate first toothed wheel 36, second toothed wheel 38 is engaged thereby so as to rotate protrusion 40 thereof eccentrically about axis 42.

It will be appreciated that the eccentric rotation of protrusion 40 results in a back and forth movement within groove 48, as shown in FIG. 4C, causing a partial rotation of member 16 in alternating directions.

Referring generally to FIGS. 5A-7, element 22 is arranged, according to the embodiments described below, to have a component of linear motion. When the reciprocating motion of element 22 is completely linear, the force delivered at every point on the element is substantially uniform and permits only such force to be delivered as is necessary to achieve a required range of motion of the element and thus provides no significant discomfort to the scalp as occurs with use of the known device to Hantman et al referred to in the background of the invention.

When the reciprocating motion of element is not completely linear, but nonetheless retains a linear component, the force delivered thereby is not necessarily as small as that delivered by an element whose motion is completely linear, but is significantly smaller than that required by the device to Hantman et al.

Figure 5A:
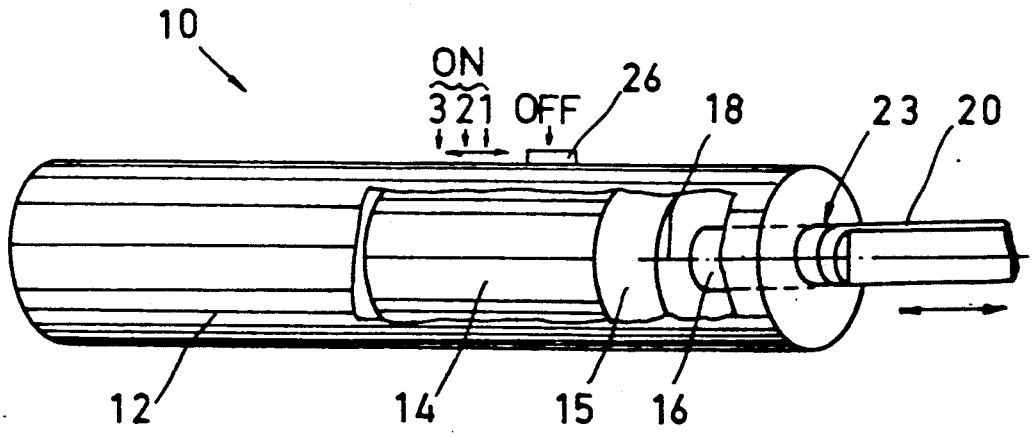
FIG. 5A is a schematic representation of hair treatment apparatus as shown in any of FIGS. 1-3, constructed and operative to produce linear reciprocal motion of the hair separation element along an axis defined thereby.

Particular reference is now made to FIG. 5A in which there is shown hair treatment device 10, wherein transmission 15 causes a reciprocal linear motion of arm 20 along axis 18, producing a similar reciprocal rotation of element 22 (FIGS. 1-3).

Figure 5B:
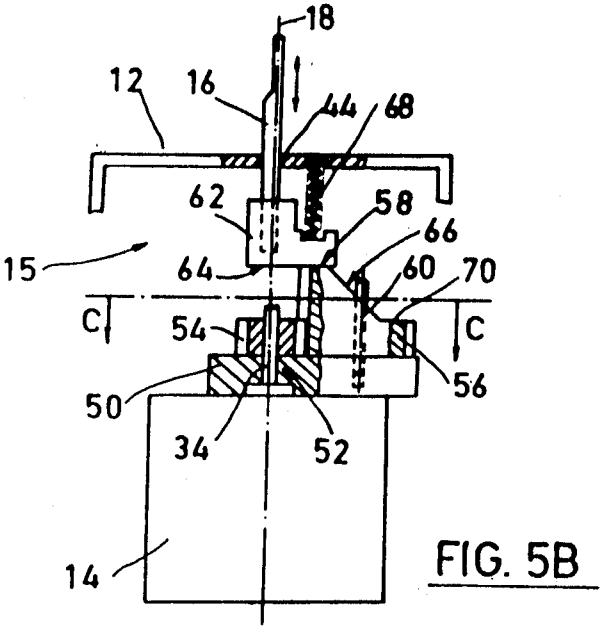
FIG. 5B is a schematic, partially cut away side view of the transmission of the apparatus shown in FIG. 5A.
Figure 5C:
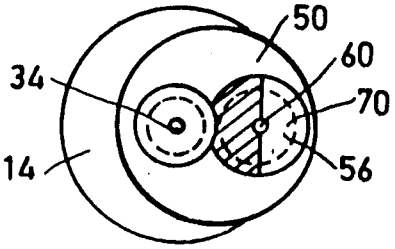
FIG. 5C is a partially cut-away view of the transmission of the apparatus of FIG. 5A, taken along line C—C in FIG. 5B.

Referring now additionally to FIGS. 5B and 5C, transmission assembly 15, according to the shown embodiment, comprises a flat base plate 50, typically made of plastic, mounted onto motor 14 and defining an aperture 52 through which rotor 34 extends. Axially mounted onto rotor 34 is a first toothed wheel 54. A second toothed wheel 56, defining a raised surface 58, is mounted onto base plate 50 for rotation about an axis 60.

Elongate member 16, which is supported in aperture 44 of housing 12 is mounted along axis 18 and extends from a member 62. Member 62 defines a bottom surface 64 which is retained in contact with a portion of an upper surface 66 of second toothed wheel 56 by a compression spring 68, extending between housing 12 and member 62.

Rotation of second toothed wheel 56 is effective to alternately bring into contact with bottom surface 64 of member 62, raised surface 58 of wheel 56 and a non-raised surface 70 thereof. As spring 68 is continually urging member 62 in the direction of motor 14, a reciprocal linear motion of arm 16 results from rotation of second toothed wheel 56 and, therefore, a similar reciprocal motion of hair separation element 22 (FIGS. 1-3).

In both the embodiment of FIGS. 4A-4D and the embodiment of FIGS. 5A-5C, the second toothed wheel has a diameter that is larger, typically by a factor of two, than the diameter of the first toothed wheel. This results in a reduced speed of rotation of the second toothed wheel compared to the speed of rotation of the first toothed wheel. Provision of toothed wheels of differing sizes thus permits, operation of the device of the present invention within a predetermined range of speeds, without particular regard to the speed of the motor.

Figure 6B:
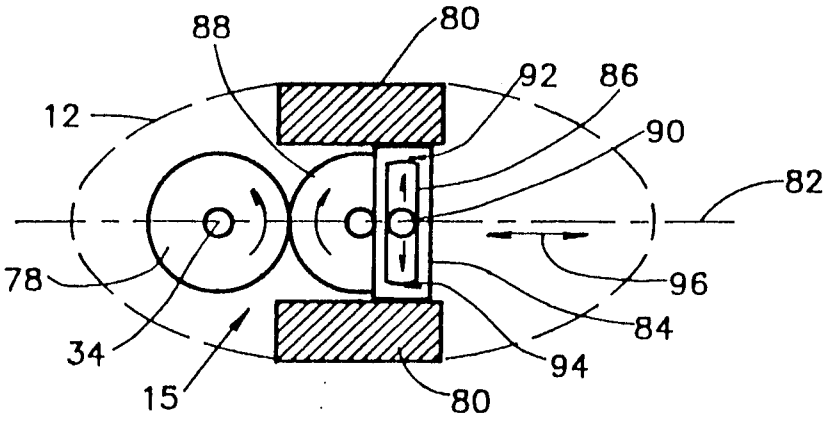
FIG. 6B is a cut away view of the apparatus of FIG. 6B, taken along line B—B therein.
Figure 6A:
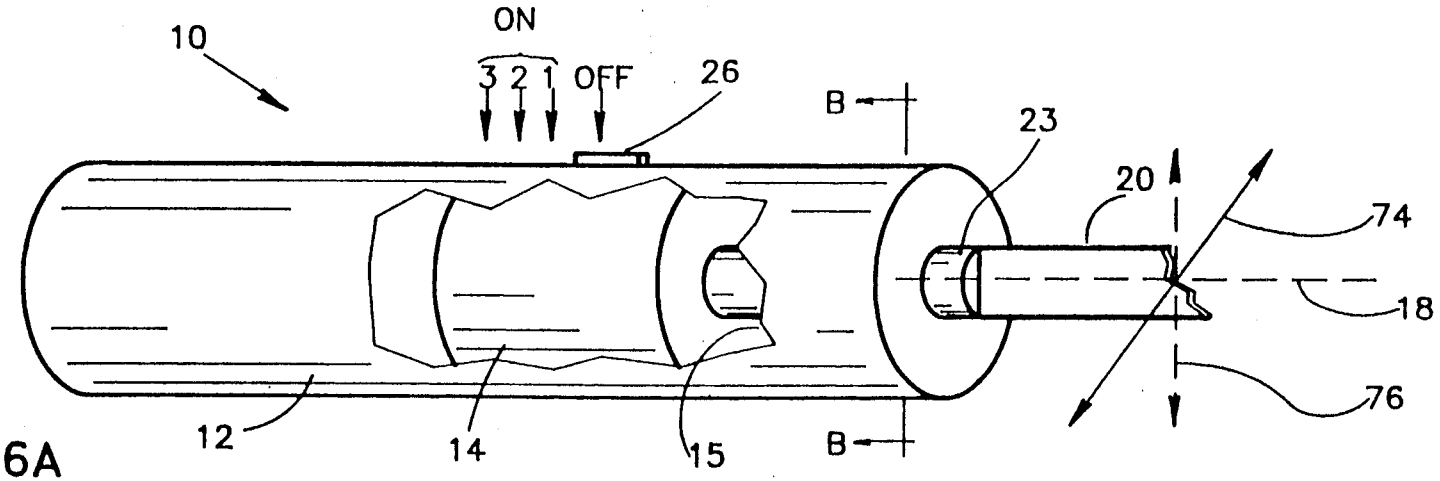
FIG. 6A is a schematic representation of hair treatment apparatus as shown in any of FIGS. 1-3, operative to produce linear reciprocal motion of the hair separation element in a direction transverse to an axis defined thereby.

Reference is now made to FIG. 6A in which there is shown hair treatment apparatus as shown in any of FIGS. 1-3, operative to produce linear reciprocal motion of the hair separation element in a direction transverse to axis 18. As will be appreciated from the ensuing description of transmission 15, element 22 may be mounted onto arm 20 as to move in any predetermined direction transverse to axis 18. For example, alternative mutually orthogonal directions are indicated at respective arrows 74 and 76.

Referring now to FIG. 6B, the transmission 15 of the device of FIG. 6A comprises a first toothed wheel 78 mounted onto rotor 34 of motor 14 (FIG. 6A). Fixed blocks 80, supported typically on an inner surface of housing 12, define parallel surfaces 81 spaced about an axis 82, lying transversely to axis 18 (FIG. 6A). Transverse axis 82 is typically parallel to either of directions shown at 74 and 76 (FIG. 6A).

A reciprocating member 84, which is attached to arm 16 (not shown), defines a groove 86, shown as hidden detail by broken lines. A second toothed wheel 88 is arranged to be rotated by first toothed wheel 78 and defines a fixed protrusion 90. Groove 86 is arranged to engage protrusion 90 such that as second toothed wheel 88 is rotated by the first toothed wheel, and consequently protrusion 90 is also rotated, protrusion 90 moves in reciprocating fashion between ends 92 and 94 of groove 86 and member 84 is also moved, so as to reciprocate from side to side as indicated by arrow 96.

This reciprocating movement is transmitted to arm 20 and, therefore, element 22 (not shown) and, depending on the orientation of element 22 with respect to housing 12, element 22 will be moved in a direction transverse to axis 18, from side to side, up and down, or in any other pair of opposing directions, according to the orientation of element 22 relative to housing 12.

Figure 7:
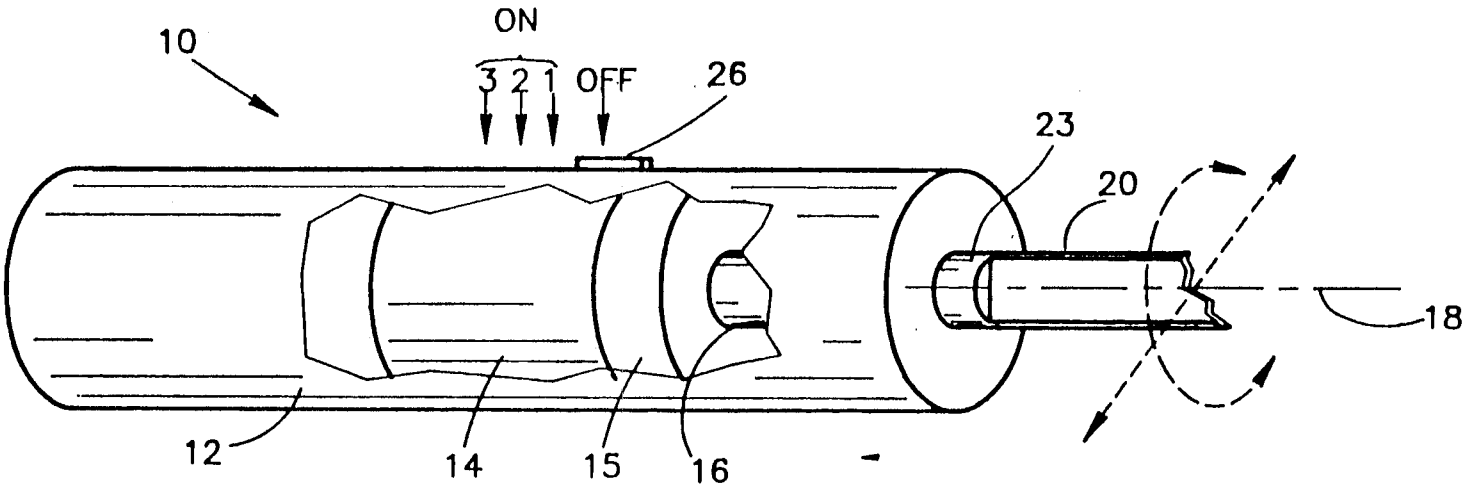
FIG. 7 is a schematic representation of hair treatment apparatus as shown in any of FIGS. 1-3, operative to produce reciprocal combination motion of the hair separation element in a direction having components of motion transverse to and about an axis defined thereby.

Reference is now made briefly to FIG. 7, in which the device 10, as shown in any of FIGS. 1-3, is shown as providing a reciprocal combination motion of the hair separation element 22 in a direction having components of motion transverse to and about axis 18. The transmission 15 useful for producing such a combined motion may be any such conventional transmission and typically as found in an electric toothbrush marketed under the trade name "Dental D3" and manufactured by Braun Ltd., West Germany.

It will be appreciated by persons skilled in the art that the device of the present invention is useful not only for human hair, but may also be used for delousing and otherwise cleaning animals.

Reference is now made to FIGS. 10 to 16, in which is shown a hand-held, portable hair treatment device, referenced generally 120, and constructed according to an alternative embodiment of the invention.

Device 120 includes a hollow handle 122, a motor 124 (similar to motor 14 as described above conjunction with FIGS. 1-7), and a transmission system 126. Motor 124 and system 126 are preferably housed within handle 122.

Motor 124 is operative to drive a first toothed wheel 126 (FIG. 11) mounted thereon, which, in turn, is operative to drive a second toothed wheel 128, mounted for rotation about a first axis 130. Second toothed wheel 128 defines an eccentrically mounted protrusion 132, which extends through a generally semicircular opening 134 (FIG. 12) in a transmission element 136.

A pair of parallel elongate members, namely, a fixed, scalp guard member 137 and a movable hair separation member 138 are mounted in association with handle 122. An intermediate elongate member 139 is movably mounted onto scalp guard member and, as described below, is operative to cooperate therewith so as to momentarily hold a group of hairs, while hair separation member 138 is simultaneously moved away from members 137 and 139 so as to free knots and tangles in the hair. The consequent pulling force that is applied to the hair by hair separation member 138 is transferred to the pair of members 137 and 139—and not to the scalp—by virtue of the momentary holding of the hairs by the pair of members.

Hair separation member 138, which is typically a lice comb or a conventional-type hair comb, defines an end portion 141 by which it is mounted onto an elongate element 140 extending through an opening 142 in handle 122 along a second axis 144. Transmission element 136 is fixedly attached to elongate element 140 substantially at right angles. As second toothed wheel 128 is rotated, causing eccentric rotation of protrusion 132 relative to first axis 130, the protrusion 132 is operative to move transmission element 136. By virtue of the semicircular shape of the opening 134 of the transmission element 136, the resulting motion of element 136 is a reciprocating rotational movement about second axis 144. As transmission element 136 and elongate element 140 are rigidly attached to each other, element 140 and, consequently, hair separation member 138 are also moved in reciprocating rotational fashion about second axis 144.

Fixed scalp guard member 137 is mounted onto handle 122 along a third axis 146 and intermediate elongate member 139 is mounted onto scalp guard member 137 so as to be movable along a fourth axis 148, parallel to third axis 146. Both of members 137 and 139 define parallel teeth 141 at right angles to respective axes 146 and 148. While the teeth are arranged in a generally comb-like fashion, they are relatively widely spaced apart in comparison with the spacing of teeth 143 of hair separation member 138. In the shown 'at rest' position, teeth 141 of members 137 and 139 are in registration with each other, so as to permit relatively easy introduction into a group of hairs.

As shown, scalp guard member 137 has a number of fixed, generally transversely arranged elements 150, each defining an opening 152 (FIG. 16) through which intermediate member 139 extends. Thus, while member 139 is permitted to move along fourth axis 148, it is secured against movement in any other direction.

With particular reference to FIGS. 12-14, transmission element 136 also defines an end protrusion 154 which is arranged for movement within a groove 156 (FIG. 14) defined by a wall portion 158 of handle 122. As element 136 moves in reciprocal fashion as described, end protrusion 154 is moved similarly within groove 156. Groove 156 has a generally curved shape, however, a lower end portion thereof being shown at 159 and an upper end portion being shown at 160. Therefore, as element 136 is moved from side to side, so as to have first components of motion as represented by double-headed arrow 162 (FIG. 14), it is forced along a path similar to that defined by groove 156, so as to have further second components of motion as shown by double-headed arrow 164, orthogonal to the first components of motion and parallel to second axis 144.

Figure 10:
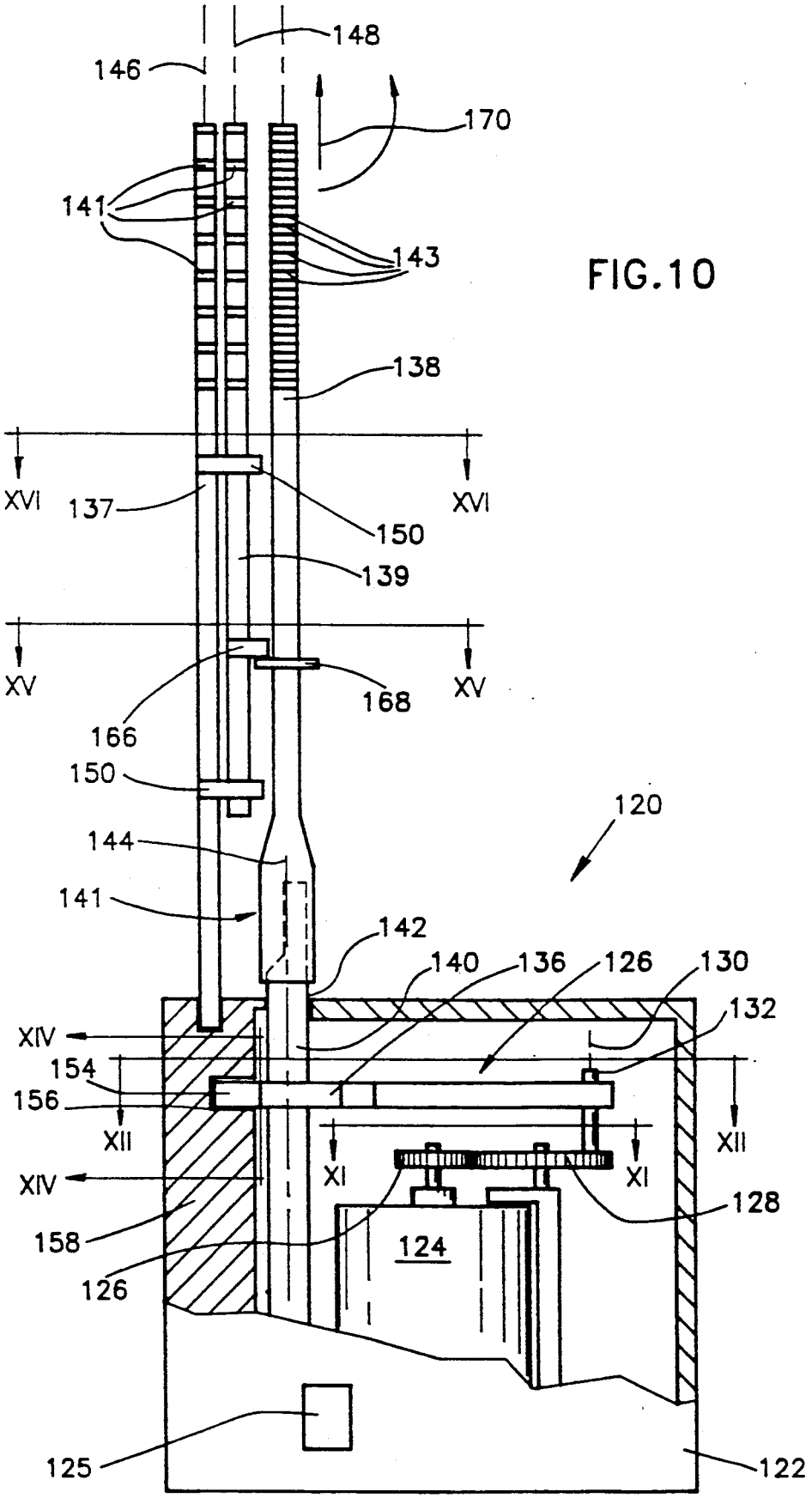
FIG. 10 is a schematic, partially cut-away view of hair treatment apparatus constructed according to an alternative embodiment of the invention.

It will be appreciated, therefore, that hair separation member 138 moves not only about second axis 144, as described, but also along the axis. As shown in FIGS. 10 and 15, fixed onto hair separation member 138 and intermediate member 139 are respective first and second transversely arranged, overlapping elements 166 and 168. As hair separation member 138 is displaced axially away from handle 122, as shown by arrow 170, first element 166 is engaged by with second protruding element 168, so as to be axially displaced thereby in a similar direction.

In operation, the three elongate members, 137, 138 and 139, are introduced into a group of hairs, with scalp guard member 137 being arranged closest to the scalp. As the motor 124 is activated, as by a switch 125, hair separation member 138 is rotated in reciprocating fashion about second axis 144, and is also simultaneously moved therealong, also in reciprocating fashion, away from handle 122, as shown by arrow 170, and back towards handle 122.

As hair separation member 138 is moved away from the handle, intermediate member 139 is displaced in a similar direction, by means of the overlapping elements 166 and 168. Scalp guard member 137 is, however, fixed relative to the handle 122, so that as member 139 moves, its teeth move out of alignment with those of scalp guard member 137 such that any intervening hairs are grasped therebetween. At the same time, hair separation element 138 is rotated about second axis 144, and, as it is moved rotationally away from member 139 and encounters knots and tangles in the hair, the force by which member 138 seeks to free the knots and tangles is transmitted not the scalp, but to the members 137 and 139, which, at that instant, are securely holding the hairs. As the hair separation member 138 moves rotationally back towards intermediate member 139, it also returns axially towards handle 122, and intermediate member 139 is thus free to be moved back into alignment with scalp guard member 137.

It will thus be appreciated that, while apparatus 120 provides a way of freeing knots and tangles from hair in a painless manner, any lice or lice eggs that are encountered by the hair separation member 138 will be fatally injured, as described hereinabove.

In an alternative embodiment of the invention, transmission system may be replaced by a simpler system providing just axial movement to the separation member 138, with no relative movement thereof occurring about axis 140.

Reference is now made to FIG. 17, which is a schematic partial view of a hand-held portable hair treatment device 172, having a handle 174 housing a motor 176 (similar to motor 124 in FIG. 10) which drives a hair separation member 178 and an intermediate member 180 relative to a fixed, scalp guard member 182, via a transmission assembly 184. Members 178, 180 and 182 have a similar arrangement to have similar constructions to the respective hair separation member 138, intermediate member 139 and scalp guard member 137 of the embodiment of FIG. 10 and are, therefore, not described herein detail.

Referring additionally to FIGS. 18 and 19, transmission assembly includes first and second toothed wheels respectively referenced 185 and 186. First toothed wheel 185 is mounted onto a rotor 187 of the motor and has a first eccentrically mounted protrusion 188 operative to engage a shaped opening 189 of a first transmission element 190 connected to intermediate member 180. Second toothed wheel 186 is arranged for rotation by first toothed wheel 185 and has a second eccentrically mounted protrusion 191 operative to engage a shaped opening 192 of a second transmission element 193 connected to hair separation member 178.

Members 178 and 180 are arranged so as to be movable along parallel axes, respectively referenced 194 and 195, while scalp guard member is mounted statically onto handle 174. In operation, motor 176 is operative to cause rotation of the first and second toothed wheels and, therefore, of the first and second eccentric protrusions. Rotation of each protrusion in the opening of each respective transmission element causes oscillation of both the hair separation member 178 and the intermediate member 180 along their respective axes.

As with the hair treatment device 120 of FIG. 10, the reciprocal motion of the intermediate member 180 relative to scalp guard member 182 causes intervening hairs to be momentarily gripped and released. The gripping occurs simultaneously with the axial oscillation of hair separation member 178 within the hair, so that member 178 is effective to free knots and tangles from the hair, while any force applied thereto is not transmitted to the scalp, but is instead absorbed by members 180 and 182.

Reference is now made to FIGS. 20A to 21B, which show a hand-held, hair treatment device, referenced generally 200, constructed and operative in accordance with a preferred embodiment of the invention.

Device 200 includes a preferably hollow handle 202, in which is housed a motor 204, typically similar to motor 14 as shown and described above in conjunction with FIGS. 1-7. Handle 202 is attached to a housing having a base 206 and a cover 208, configured to fit over the base. Base 206 defines a number of openings 210 which are separated by transverse, relatively wide, teeth-like protrusions 212.

Figure 20A:
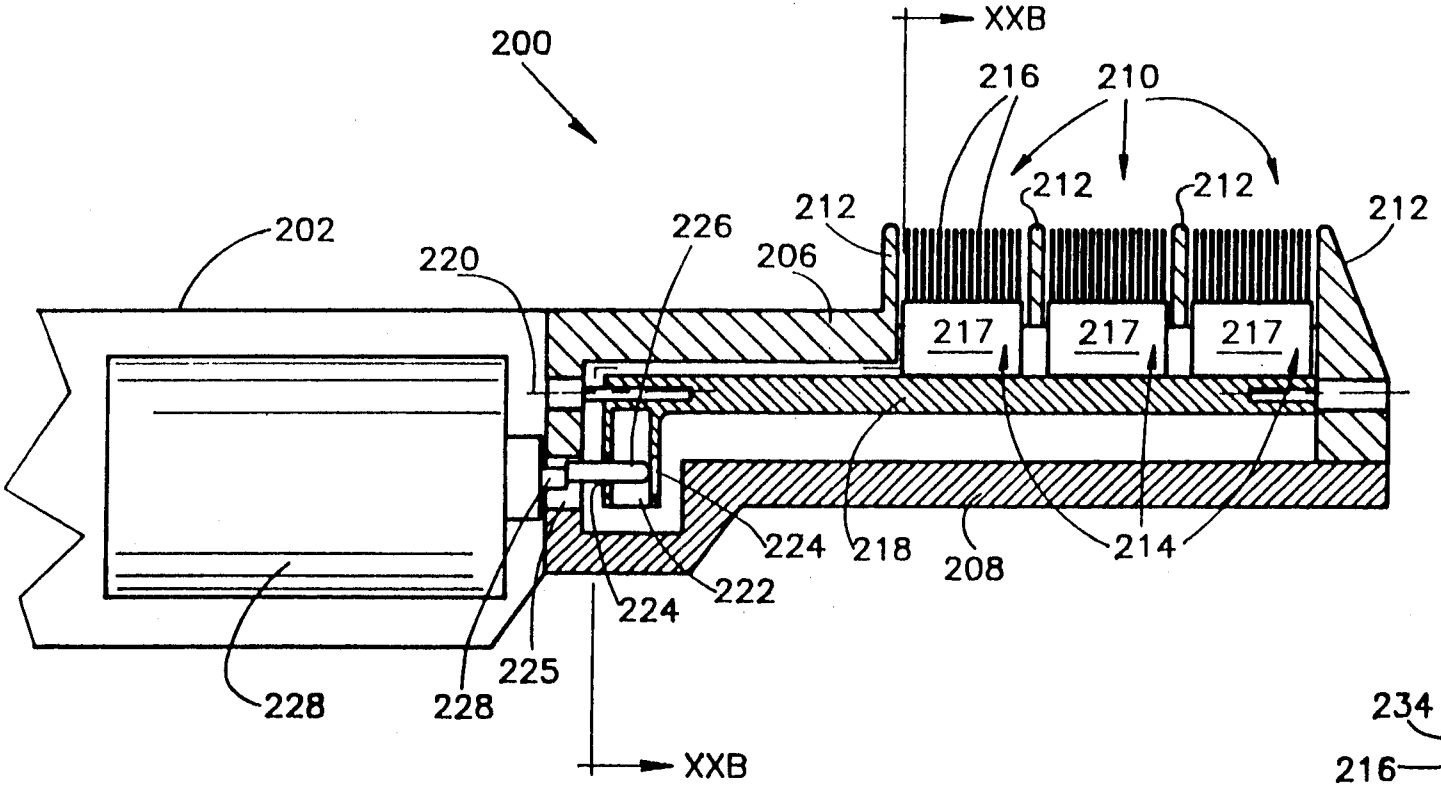
FIG. 20A is a schematic, partially cut-away view of hair treatment apparatus constructed according to an additional embodiment of the invention.
Figure 20B:
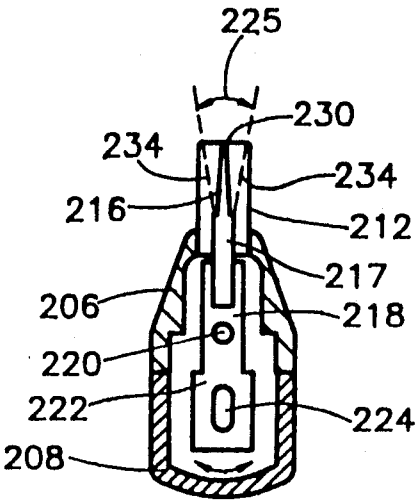
FIG. 20B is a cross-sectional view of the apparatus of FIG. 20A, taken along line XXB—XXB therein.
Figure 21B:
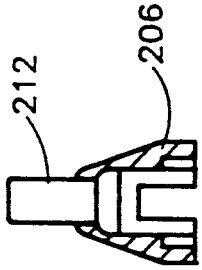
FIG. 21B is a cross-sectional view of the apparatus of FIG. 21A, taken along line XXIB—XXIB therein.
Figure 21A:
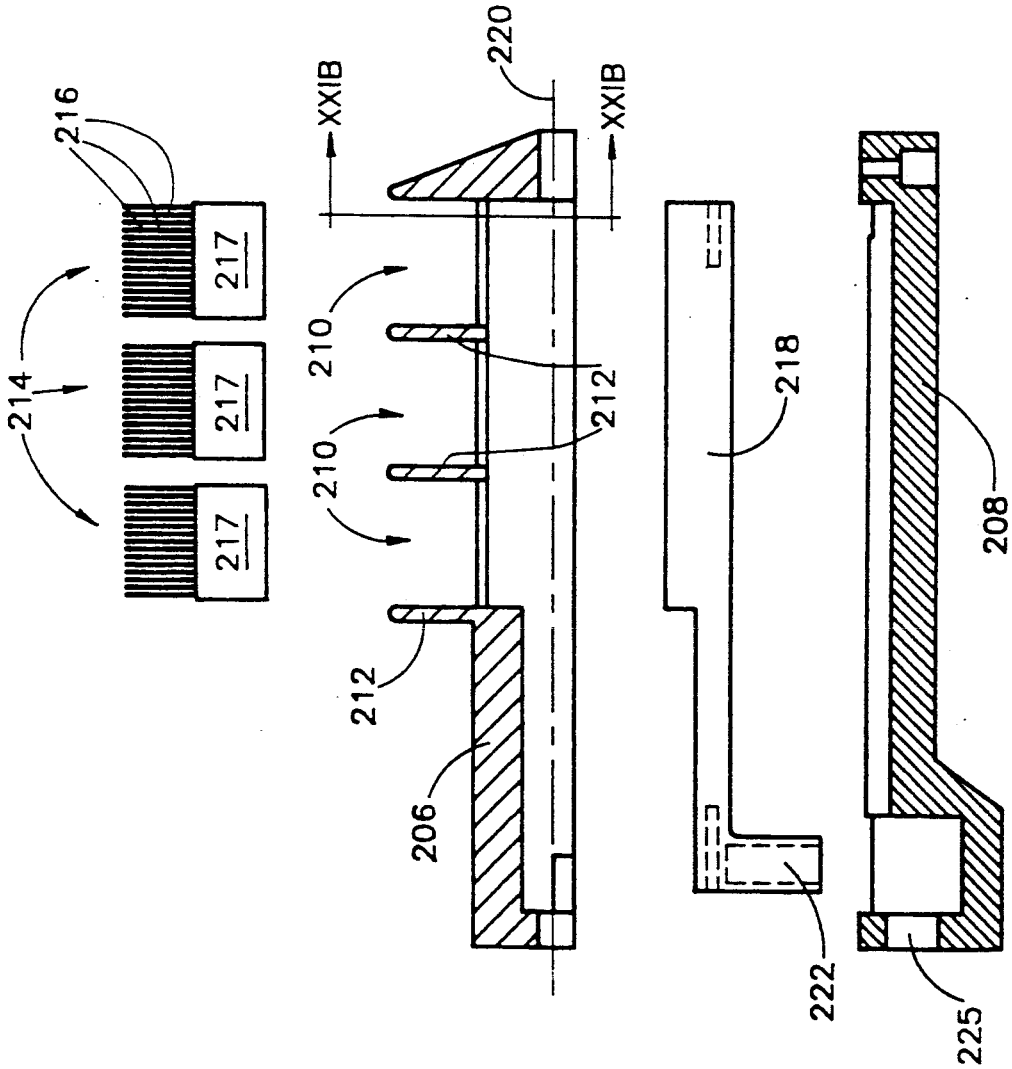
FIG. 21A is an exploded, partially cut-away view of the apparatus of FIG. 20A.

A plurality of comb elements 214, each having a predetermined number of teeth 216 protruding outwardly from base portions 217, are arranged for insertion into, and are thus supported by, an elongate comb support 218. Comb support 218 is mounted in base 206 for rotation about an axis 220. Protrusions 212 and teeth 216 are arranged perpendicular to rotation axis 220. As shown, each comb element 214 is arranged in one of openings 210 and, as shown in FIG. 20B, teeth 216 are much narrower than protrusions 212. As will be appreciated from the ensuing description, protrusions 212 provide a means of protecting the scalp from the reciprocating motion of 216 (described below), while not interfering with it.

Comb support 218 defines, at its end closest to the handle 202, a downwardly extending, transverse portion 222, which defines a pair of similar openings 224. Openings 224 are in mutual alignment in a direction parallel to the rotation axis 220, and they are generally elongate in shape, their long dimension being substantially perpendicular to the rotation axis 220.

Openings 224 are arranged for engagement by an eccentric portion 226 defined by a rotation element 228 mounted onto the rotor (not shown) of the motor 204 and extending through an opening 225 provided in a rear portion of cover 208. As will be appreciated by persons skilled in the art, rotation of rotation element 228 causes eccentric rotation of the eccentric portion 226. The motion of portion 226 may thus be divided into linear components of motion along first and second mutually perpendicular axes (not shown), the first axis being parallel to the direction of teeth 216 and the second axis being perpendicular to the direction of teeth 216 and to the rotation axis 220.

As eccentric portion 226 is rotated, its movement is not restricted in the direction parallel to teeth 216, as it is free to reciprocate between the ends of 224. In the direction perpendicular both to the direction of teeth 216 and to the rotation axis 220, however, eccentric portion 226 is operative to reciprocally move the transverse portion 222 and, therefore, comb support 218 and comb elements 214, in a side to side motion about rotation axis 220, as shown by arrow 225 (FIG. 20B).

It is a particular feature of the present embodiment that, as shown in FIG. 20B, teeth 216 are shorter and narrower than protrusions 212, and the described reciprocating movement of teeth 216 about axis 220 is confined to a sector defined by the projection of the free end 230 of each protrusions 212. This sector of motion is indicated by arrow 225 and broken lines 234 and ensures that teeth 216 are prevented from striking the scalp when the device 200 is in use. Protrusions 212 constitute, therefore, a scalp guard.

Accordingly, when the device 200 of the present invention is used, protrusions 212 are moved along the scalp in combing fashion, but while teeth 216 are nor permitted to strike the scalp, they are brought sufficiently close to the scalp so as to fatally injure lice and lice eggs present in the hair and to loosen and remove dandruff and other unwanted particulate matter from the scalp, as described hereinabove. The motion of teeth 216 is, as with previous embodiments, also effective to free knots and tangles in the hair.

As with previously described embodiment of the invention, comb elements may have either a lice comb or a more conventional, pocket comb type of construction. Although the spacing between protrusions 212 may be any preferred spacing, it should not be so great that the comb teeth 216 could strike the scalp. This could happen due to the curvature of the head. The spacing between protrusions 212 is thus typically between 5 mm and 20 mm, although preferably between 10 mm and 15 mm.

In addition, the number of teeth provided on each comb element 214 may also be varied, according to the type of comb. Thus, when the construction of comb elements is that of a lice comb, depending on the spacing selected, each comb element preferably has between 15 and 40 teeth. When the construction of the comb elements is that of a more conventional pocket comb, typically 3 to 10 teeth are provided on each comb element. It will also be appreciated that while with a lice comb construction a generally shorter overall length will be sought, such that typically three comb elements are used, with a more conventional construction, a generally longer overall length will be sought, and between three and fourteen comb elements, for example, may be employed.

A further feature of the present embodiment is that the entire portion of each tooth 216 that engages the hair is spaced from the rotation axis 220, so that no 'dead point' exists on the tooth, as described above in detail in conjunction with FIGS. 1-3. In the shown embodiment, the spacing of each tooth from the rotation axis is approximately equal to the length of the tooth, rather than the minimal one-quarter ratio described above in conjunction with FIGS. 1-3.

A further advantage of the present embodiment is the high frequency of oscillation of the comb elements, the frequency being typically greater than 3,000 cycles per minute (CPM), preferably greater than 4,000 CPM and, more preferably, between 10,000 and 15,000 CPM. It will be appreciated that such high frequency oscillations render even a relatively small amplitude of oscillation to be highly effective in achieving the aims of the invention. Accordingly, therefore, the oscillation of the comb elements is typically no greater than about 5°, and preferably about 1°-2°.

Figure 22:
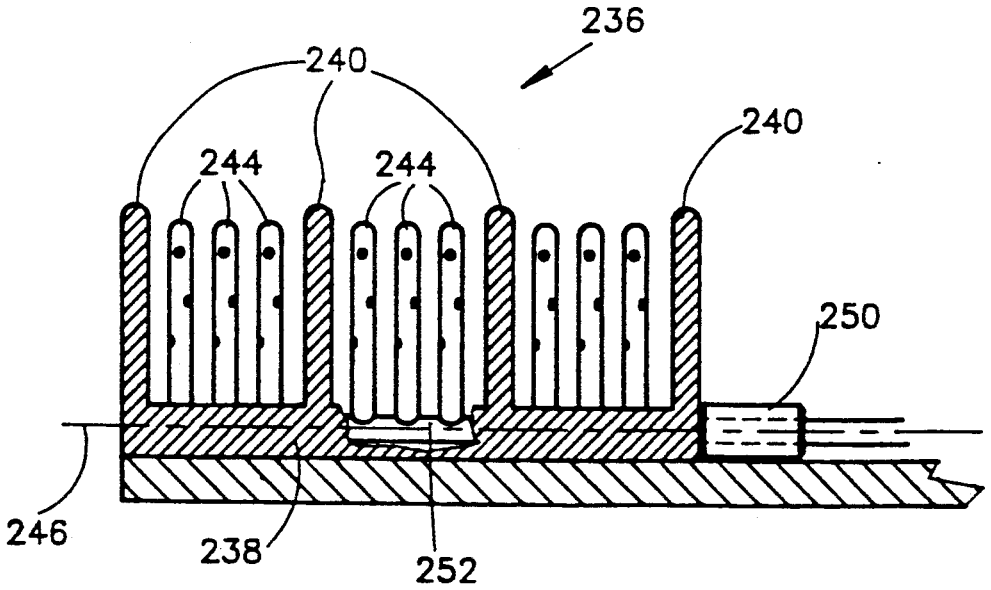
FIG. 22 shows a head portion useful with the apparatus of FIGS. 21A-21B, wherein the head portion has been constructed so as to permit the dispensing of liquids therefrom.

Reference is now made to FIG. 22, which shows the head portion 236 of apparatus similar to device 200 (FIGS. 20A-21B), but wherein the head portion is constructed so as to permit the dispensing of liquids therefrom. The use of liquids may include the use of any liquid having a potentially beneficial effect on the hair and/or scalp of the user, and include the use of known chemical preparations for eliminating lice and their eggs as a supplement to the use of the apparatus of the invention. Head portion 236 thus includes a base 238 defining a plurality of protrusions 240, similar to protrusions 212 of base 206 described above in conjunction with FIGS. 20A-21B, and a cover 242 for the base.

A plurality of teeth 244 are also provided, being shorter and narrower than protrusions 240, and being reciprocally rotatable about an axis 246. The limits of the reciprocal rotation of teeth 244 relative to the protrusions 240, are similar to those described above for teeth 216 relative to protrusions 212 (FIG. 20B) and are thus not described here in detail.

Figure 23:
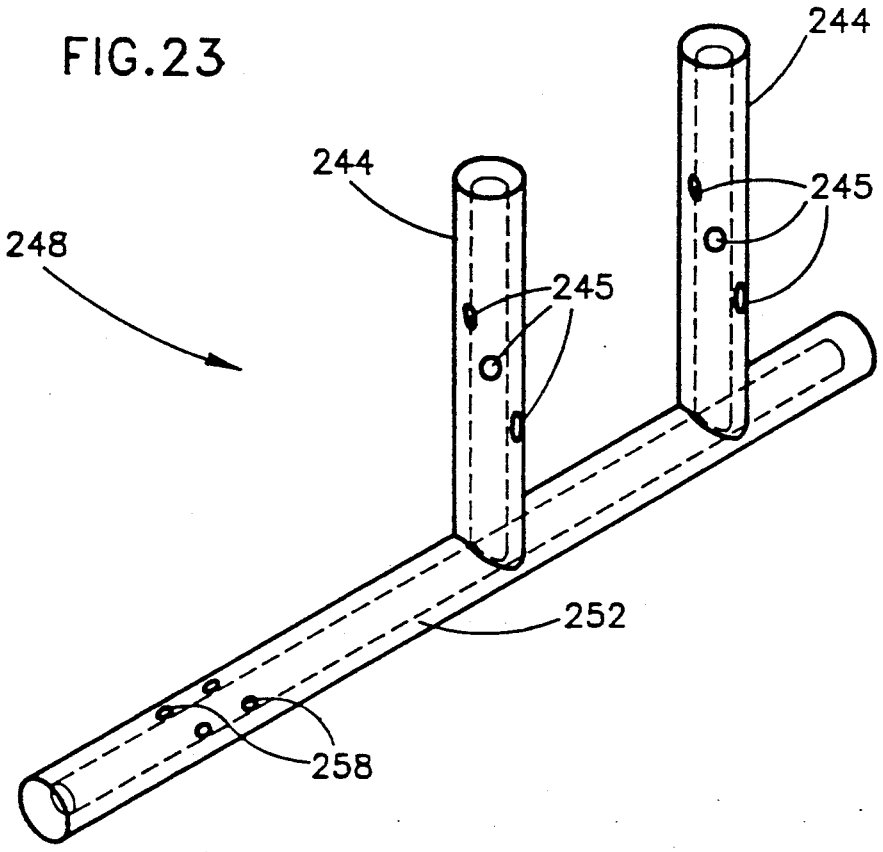
FIG. 23 is a schematic, enlarged, perspective view of a portion of a conduit system used in the modified head of FIG. 22.

Referring additionally to FIG. 23, each tooth 244 is hollow and defines a number of liquid outlet apertures 245, which permit dispensing of a liquid at predetermined points along the length of the teeth 244. Hollow teeth 244 form part of a conduit system 248, whereby each tooth 244 is connected to a container 250 containing a liquid for dispersal in the hair, via a rigid main distribution tube 252, arranged within base 238 and lying along rotation axis 246.

Referring also to FIGS. 24-25B, tube 252 extends through container 250 and is operative to be reciprocally rotated by a motor (not shown), such as motor 204 described in conjunction with the embodiment of FIGS. 20A-21B. Container 250 typically is a drum defining an interior annular volume which is arranged about tube 252. Liquid is permitted to enter tube 252 via outlet ports 254 provided in an inner wall 256 of the container and inlet ports 258 provided in a portion of tube 252 surrounded by inner wall 256 of the container. Container 250 is preferably rotatable about tube 252, so that the outlet ports 254 of the container can be moved out of alignment with the inlet ports 258 of the tube 252, as shown in FIG. 25B, so as to prevent undesired flow of liquid.

Even when outlet ports 254 and inlet ports 258 are in alignment, as shown in FIG. 25A, liquid will not flow freely unless pressure is applied to the liquid in the container, such as by means of a piston member 260 (FIG. 24). A flow control 262 is provided for selectably moving the piston member (FIG. 24) in the shown direction. Container 250 also includes an opening 264 permitting refilling with a selected liquid. It will be appreciated that the container 250 and piston member 260 used in conjunction therewith constitute just one example of a system for supplying a liquid to teeth 244 for dispersal in the hair, and that any suitable system may be employed for this purpose.

It will also be appreciated by persons skilled in the art that the present invention is not limited by what has been particularly shown and described hereinabove. The scope of the invention is limited, rather, solely by the claims, which follow.

We claim:

1. Apparatus for treating hair comprising:

a handle;

hair separation means associated with said handle, extending longitudinally along an axis;

means for oscillating said hair separation means about said axis and for bringing said hair separation means into repeated engagement with a group of hairs so as to ease passage of said separation means therethrough; and means extending generally parallel to and spaced from said hair separation means and extending longitudinally therebeyond for substantially preventing said hair separation means from striking skin to which the hairs are attached when said hair separation means is substantially close to said skin.

2. Apparatus according to claim 1, and wherein said hair separation means comprises hair combing means comprising:

generally elongate base means arranged along said axis; and a plurality of teeth lying transversely to said axis and attached to said base means so as to be separated from said axis.

3. Apparatus according to claim 2, and wherein said means for at least partially preventing striking comprises a generally elongate static member arranged parallel to said axis.

4. Apparatus according to claim 3, and wherein said means for oscillating is operative to cause oscillation of said plurality of teeth within a predetermined area, and said elongate static member has a comb-like configuration and comprises:

a generally elongate base portion; and a plurality of spaced apart tooth-like transverse protrusions fixed to said base portion, said protrusions extending beyond an area of movement of said plurality of teeth so as to at least partially prevent striking of the skin by said plurality of teeth.

5. Apparatus according to claim 4, and wherein said teeth are arranged parallel to and between said transverse protrusions, and said protrusions are longer than said teeth.

6. Apparatus according to claim 5, and wherein said teeth have free ends not connected to said elongate base means, and wherein said transverse protrusions are wider than said teeth in a direction perpendicular to said axis, and said means for oscillating is operative to oscillate said hair separation means between predetermined limits such that in a direction parallel to said axis, at least the free ends of said teeth always overlap said protrusions.

7. Apparatus according to claim 4 wherein said plurality of teeth is more than twice as large said plurality of protrusions.

8. Apparatus according to claim 3, and wherein said oscillation of said hair separation means is operative to ease passage of said hair separation means through the group of hairs by repeatedly striking the hairs so as to remove therefrom knots and tangles, said apparatus for treating hair also comprising means for absorbing a striking force applied to the hairs so as to prevent said striking force from being transmitted to the portion of skin to which the hairs are attached.

9. Apparatus according to claim 9, and wherein said means for absorbing comprises means for gripping the hairs at a location relatively close to the skin.

10. Apparatus according to claim 9, and wherein said elongate static member is arranged parallel to said hair separation means, and said means for absorbing is an additional, generally elongate member having tooth-like protrusions arranged in similar fashion to said tooth-like protrusions of static member and slidably mounted onto said static member, said apparatus for treating hair also including means for causing repeated momentary displacement of said additional member along said elongate static member simultaneously with said striking of hairs by said hair separation means, thereby causing the hairs to become momentarily trapped between said teeth-like protrusions of said static member and said additional member.

11. Apparatus according to claim 2, and also including means for dispensing a liquid in association with at least some of said plurality of teeth.

12. Apparatus according to claim 11, and wherein at least some of said teeth are at least partially hollow and define liquid outlet ports, and said means for dispensing comprises:

liquid reservoir means associated with said handle; and means for permitting the supply of the liquid from said reservoir means to each of said hollow teeth, thereby causing dispensing of the liquid through said liquid outlet ports.

13. Apparatus according to claim 1, and wherein said hair separation means is a lice comb.

14. Apparatus according to claim 1, and wherein said means for oscillating is operative to oscillate said hair separation means about said axis at a frequency of greater than 4,000 cycles per minute.

15. Apparatus for treating hair including:

a handle;

hair combing means comprising:

generally elongate base means arranged along an axis, and a plurality of teeth lying transversely to said axis, each being attached to said base means so as to be separated from said axis along a distance equal to at least one-quarter of the length of said tooth; and means for oscillating said hair combing means about said axis at a relatively high frequency and at a relatively small amplitude so as to bring said hair separation means into repeated engagement with a group of hairs, thereby to ease passage of said hair combing means therethrough, and wherein said means for oscillating is operative to oscillate said hair combing means at a frequency greater than 4,000 cycles per minute and at an amplitude no larger than about 5°.

16. Apparatus for treating hair comprising:

a handle;

hair separation means associated with said handle and extending longitudinally along an axis;

means for oscillating said hair separation means in a direction having at least a component along said axis, for bringing said hair separation means into repeated engagement with a group of hairs so as to ease passage of said separation means therethrough and for repeatedly striking the hairs so as to remove therefrom knots and tangles;

means for absorbing a striking force applied to the hairs so as to prevent said striking force from being transmitted to a portion of skin to which the hairs are attached; and means extending generally parallel to and spaced from said hair separation means and extending longitudinally therebeyond for substantially preventing said hair separation means from striking skin to which the hairs are attached.

17. Apparatus according to claim 16, and wherein said means for absorbing comprises means for gripping the hairs at a location relatively close to the skin.

18. Apparatus according to claim 17, and wherein said hair separation means comprises generally elongate hair combing means, and said means for at least partially preventing comprises a generally elongate static comb-like member arranged parallel to said axis.

19. Apparatus according to claim 18, and wherein said means for absorbing is an additional, generally elongate comb-like member disposed between said elongate hair combing means and said static comb-like member, and said means for oscillating also includes means for oscillating said additional comb-like member simultaneously with said striking of hairs by said hair combing means, thereby causing the hairs to become momentarily trapped between said static comb-like member and said additional comb-like member.

20. A method of delousing hair comprising the following steps:

placing hair separation means in a group of hairs having a given length along an axis;

oscillating said hair separation means at high frequency;

bringing said hair separation means into repeated engagement with the group of hairs in a direction generally transverse to the hairs along said axis;

striking said hairs with said hair separation means thereby also bringing said hair separation means into repeated engagement with lice and lice eggs located among the hairs, so as to cause fatal injury to the lice and lice eggs; and employing means extending generally parallel to and spaced from said hair separation means and extending longitudinally therebeyond for substantially preventing said hair separation means from striking skin to which the hairs are attached.

21. A method according to claim 20, and wherein said step of oscillating comprises the step of oscillating said hair separation means about an axis.

22. A method according to claim 20, and wherein said step of oscillating includes the step of preventing said hair separations means from striking a portion of skin to which the group of hairs is attached.

23. A method according to claim 20, and also including the step of dispensing a liquid in association with said hair separation means.

24. A method according to claim 20, and also including the step of absorbing a force applied to the hairs in said step of oscillating, so as to prevent the force from being transmitted to a portion of skin to which the hairs are attached.

25. A method according to claim 24, and wherein said step of oscillating comprises the step of oscillating said hair separation means along an axis.

26. A method according to claim 24, and wherein said step of absorbing comprises the step of gripping the hairs at a location relatively close to the skin.

27. A method according to claim 21, and wherein said step of oscillating comprises the step of oscillating said hair separation means about said axis at a relatively high frequency and at a relatively small amplitude.

28. A method according to claim 27, and wherein said step of oscillating comprises the step of oscillating said hair separation means at a frequency greater than 4,000 cycles per minute and at an amplitude no larger than about 5°.

29. A method according to claim 28, and wherein said step of oscillating comprises the step of oscillating said hair separation means at a frequency greater than 10,000 cycles per minute and at an amplitude no larger than 2°.

30. A method according to claim 20, and wherein said hair separation means is a lice comb.

31. Apparatus for treating hair comprising:

a handle;

hair separation means associated with said handle, extending longitudinally along an axis, and having teeth;

means for oscillating said hair separation means about said axis and for bringing said hair separation means into repeated engagement with a group of hairs so as to ease passage of said separation means therethrough; and means having protrusions extending generally parallel to and spaced from said hair separation means and extending longitudinally therebeyond for substantially preventing said hair separation means from striking skin to which hairs are attached;

wherein said protrusions extend beyond said teeth.

32. Apparatus for treating hair comprising:

a handle;

hair separation means associated with said handle, extending longitudinally along an axis, and having teeth;

means for oscillating said hair separation means in a direction having at least a component along said axis, for bringing said hair separation means into repeated engagement with a group of hairs so as to ease passage of said separation means therethrough and for repeatedly striking the hairs so as to remove therefrom knots and tangles;

means for absorbing a striking force applied to the hairs so as to prevent said striking force from being transmitted to skin to which the hairs are attached; and means having protrusions extending generally parallel to and spaced from said hair separation means and extending longitudinally therebeyond for substantially preventing said hair separation means from striking skin to which hairs are attached;

said protrusions extending beyond said teeth.

* * * * *